US006302343B1

(12) United States Patent
Engel et al.

(10) Patent No.: US 6,302,343 B1
(45) Date of Patent: Oct. 16, 2001

(54) TEXTILE TUBE

(75) Inventors: Adalbert Engel, Drosselweg 4, 79540 Lörrach; Christoph Engel, Rimbach/Niederbayern; Uta-Maria Engel, Hofheim-Wildsachen, all of (DE)

(73) Assignee: Adalbert Engel, Lorrach (DE)

( * ) Notice: Subject to any disclaimer, the term of this patent is extended or adjusted under 35 U.S.C. 154(b) by 0 days.

(21) Appl. No.: 09/406,864

(22) Filed: Sep. 27, 1999

(30) Foreign Application Priority Data

Sep. 29, 1998 (DE) ..... 198 44 653

(51) Int. Cl.[7] ..... B65H 75/20; B65H 75/08

(52) U.S. Cl. ..... 242/118.11; 242/118.31; 242/118.32; 242/605; 242/613.5

(58) Field of Search ..... 242/118.1, 118.11, 242/118.2, 118.31, 118.32, 604, 605, 613.5

(56) References Cited

U.S. PATENT DOCUMENTS

| | | | | |
|---|---|---|---|---|
| 3,532,291 | * | 10/1970 | Newman | 242/118.31 |
| 3,715,454 | * | 2/1973 | Kleykamp | 174/47 |
| 4,108,396 | | 8/1978 | Engel . | |
| 4,113,828 | | 9/1978 | Kramer, Sr. et al. . | |
| 4,462,556 | * | 7/1984 | Grahm, Jr. | 242/118.31 |
| 4,720,057 | * | 1/1988 | Ono et al. | 242/118.11 |
| 5,445,335 | * | 8/1995 | Hallmann et al. | 242/118.1 |
| 5,501,406 | * | 3/1996 | Henning | 242/118.11 |

FOREIGN PATENT DOCUMENTS

| | | |
|---|---|---|
| 24 09 020 A1 | 9/1975 | (DE) . |
| 25 06 512 A1 | 8/1976 | (DE) . |
| 25 40 273 A1 | 3/1977 | (DE) . |
| 0 271 971 A1 | 6/1988 | (EP) . |

* cited by examiner

*Primary Examiner*—Michael R. Mansen
(74) *Attorney, Agent, or Firm*—Akin, Gump, Strauss, Hauer & Feld, L.L.P.

(57) ABSTRACT

A textile tube (1) made in an injection-blow molding process and/or an injection evacuation process has a wall (2) with a wave profile with ring-shaped surrounding inward bulges (3) and outward bulges (4) alternately arranged side by side in an axial direction. The textile tube (1) has perforations (5). In several places arranged offset in relation to each other in a circumferential direction, the textile tube (1) has several strip-shaped areas (7) of a rigidity that differs from the rigidity of radially adjacent areas of the textile tube, and the strip-shaped areas (7) substantially follow the shape of the casing of the textile tube. In the case of fastenable textile tubes, a coupling is provided with a coupling aperture enclosed by a flexible wall area (16) and a matching rigid end lip (15) with the wall section (18) adjoining the end lip (15) being of equally flexible construction.

13 Claims, 8 Drawing Sheets

TEXTILE TUBE

BACKGROUND OF THE INVENTION

The invention relates to a textile tube made in an injection-blow molding process and/or an injection evacuation process, with at least a partial area of the wall of the textile tube comprising a wave profile with ring-shaped inward bulges and outward bulges alternately arranged side by side in the axial direction, wherein the textile tube has perforations.

Such a textile tube is known from German published patent application DE 25 06 512 A1 (U.S. Pat. No. 4,108,396; Brazilian patent 7600933) and has proven itself. Above all, it is advantageous that such a textile tube is axially highly deformable even in the cold state, so that after winding with windable textile material, for example a yarn, it can be compressed in axial direction, so as to require as little space as possible during subsequent heat treatment and/or wet processing of the textile material. It is in particular also advantageous with such heat treatment and/or wet processing that the tube casing, which is approximately wave shaped in the longitudinal direction, provides good radial resilience.

For certain applications it has been proven to be advantageous to match the axial and radial flexibility of the textile tube to the particular process steps for treating the textile material for the respective individual applications. To achieve this, it is already known to provide textile tubes with different wall thicknesses. For example for an application requiring a flexible textile tube, a thin-walled textile tube is used, while for an application requiring increased rigidity, a thicker-walled tube is used. For example, higher rigidity of the textile tube can improve its concentric-running stability on spindle-less winding devices. It is, however, unfavourable that textile tubes of increased wall thickness are also heavier, thus requiring accordingly more material during manufacture. Such textile tubes are therefore comparatively expensive. A further disadvantage consists in the interior diameter of the textile tube having to be matched as exactly as possible to the diameter of the adaptation elements of a winding device provided for the textile tube. However, maintaining a constant interior diameter is impossible without a change in tooling, when producing textile tubes of differing wall thicknesses using hollow shapes in injection-blow molding or injection evacuation processes.

SUMMARY OF THE INVENTION

It is thus an object of the present invention to provide a thin-walled textile tube of the type mentioned above, which is economical to produce and which permits gentle treatment of the textile material wound onto it, both during winding and during pressing.

With regard to a textile tube of the type mentioned in the introduction, this object is met in that the textile tube comprises several strip-shaped areas, arranged at its circumference, which strip-shaped areas extend continuously in axial direction across adjacent inward bulges and outward bulges with a rigidity that differs from the rigidity of radially adjacent areas of the textile tube, and in that the strip-shaped areas essentially follow the wave profile of the wall of the textile tube, such that the exterior shape of the casing of the textile tube is substantially or completely preserved.

Thus, the exterior shape of the textile tube, important for winding, remains substantially unchanged, but the textile tube derives a defined elasticity or rigidity from strip-shaped areas extending in the longitudinal direction along adjacent inward bulges and outward bulges. Consequently, higher precision is attained both during winding and cold pressing, leading to a more gentle treatment of the textile material and, in particular, more even transfer of the forces to which the textile material is exposed during pressing. The textile tube can have perforations at any desired locations, in particular in the area of the inward bulges or outward bulges.

A particularly advantageous embodiment of the invention provides for the strip-shaped areas to be reinforcements. This can be achieved, for example, in that the material of the strip-shaped areas is more rigid or of increased tensile strength when compared to the adjacent wall-material of the textile tube. This results in a thin-walled, but nevertheless stable and light, textile tube with good concentric-running stability. As a result, for example in the casing of spindle-less winding systems, any wobbling and/or jumping-off of the textile tube from the winding system, as well as the accompanying thread breakage, can largely be prevented. In addition, a good shape of the casing is achieved in spite of differences in wall thickness within normal limits. It must also be mentioned that textile tubes according to the invention, when compared to tubes made with an injection molding lattice construction, make possible a more even and thus more gentle support of the textile material during cold pressing and the subsequent heat treatment and/or wet processing.

It is advantageous if the strip-shaped areas are reinforcement ribs integrated in one piece with the wall of the textile tube, which ribs on the inside of the wall of the textile tube are essentially radially developed in the outward bulges, and in the area of the inward bulges are of smaller radial dimensions than in the area of the outward bulges. The reinforcement ribs increase the rigidity of the textile tube, with the high axial deformability essentially being maintained. The reinforcement ribs make it possible to provide a textile tube with good concentric-running stability and comparatively low weight.

An advantageous embodiment of the invention provides for the strip-shaped areas to be recessed in the outside wall of the textile tube, and for the material of the strip-shaped areas to be of different rigidity than the adjacent textile tube material. The dimensions of the textile tube can then be the same as those of a conventional thin-walled textile tube, so that the injection molding heads already existing for the manufacture of such textile tubes can continue to be used. Nevertheless, when compared to a known textile tube, the textile tube according to the invention, depending on the rigidity of the strip-shaped areas, may be of different axial and/or radial elasticity.

The molecular weight of the material of the strip-shaped areas can be higher than that of the adjacent textile tube material, located between adjacent strip-shaped areas. This results in a thin-walled textile tube of good concentric-running stability, which nonetheless provides good deformability in axial and radial directions.

An advantageous embodiment provides for the strip-shaped areas comprising strips to extend in the radial direction. This can be achieved, for example, in that during extrusion of the textile tube material, from the direction of the outside of the extruded material, replastifiable strips of hardened plastic are fed in. The blowing process or evacuation process then results in a textile tube with strips extending in the axial direction on the outside, pressed into the wall of the textile tube, with the outside of the textile tube, in radial direction, comprising an even and gradual shape without any protruding areas.

An advantageous embodiment provides for the strip-shaped areas to comprise a thread sheet grouped flat and wide, and optionally for the threads of the thread sheet to be interconnected by welding. The threads may be, for example, synthetic threads interconnected by ultrasound welding. In this way, the thread sheets are easier to handle during the production of the textile tubes. It is possible, for example, to feed the said thread sheets during the extrusion process to the thermoplastic textile tube material in the cold state.

The strip-shaped areas can, however, also comprise textile fabrics with metallic filament or staple fiber fractions or metallized monofilament and/or multifilament synthetic threads. Fabric can denote a woven structure, a mesh, a bonded fiber fabric and/or a braid. The strip-shaped areas can also comprise metallic components, in particular multifilaments or monofilaments spirally covered by metal threads. In this case, the metallic components provide a spring-like action resulting in a particularly elastic textile tube, which is nevertheless suitable for use with automatic machinery.

A particularly advantageous embodiment provides for the strip-shaped areas to be flat tension elements of any kind described above, which at least in certain areas are welded on the outside to the wall of the textile tube, in particular by means of laser and/or ultrasound welding. In this case, the injection-blow molding equipment or injection evacuation equipment used in the production of conventional textile tubes can then be used for producing the textile tube according to the invention, contributing to its economical production. Preferably, the tension elements are partly welded onto the wall of the textile tube, in particular in the area of the inward bulges. Consequently, the textile tube has a high axial and radial deformability, while at the same time being stabilized by the tension elements.

A preferred and advantageous embodiment of the invention provides for the textile tube to be able to be clipped onto a further textile tube, with the textile tubes comprising a coupling aperture at one of their respective axial ends facing away from each other, and at their other axial ends comprising an end lip able to be clipped into the coupling aperture of the other textile tube; in that the exterior circumference of the end lip comprises a receptacle for a thread reserve; and in that the wall area enclosing the coupling aperture of the textile tube and/or the radial wall section of the textile tube, which wall section adjoins the end lip, preferably comprise(s) a lesser wall thickness than the end lip. The interior longitudinal ribs therein, which comprise a solid cross-section, extend beyond the wall area enclosing the coupling aperture, right up to the coupling aperture and/or right up to the free end of the end lip. The wall area enclosing the coupling aperture and/or the wall section adjoining the end lip are/is preferably arranged radially and allow(s) gentle elastic compaction of the thread reserve or of the reserve windings during cold pressing. Radial extension, and thus more or less pronounced flexibility, of the wall section adjoining the end lip and of the wall area enclosing the coupling aperture, is essentially determined by the required diameter of the interior rigid end lip.

This design practically excludes any destruction (by water) of the thread reserve during wet processing, even if the interior end lip is perforated. In addition, the coupling components connected with a positive fit in the coupled position of the clipped-together textile tubes, namely the wall section adjacent to the coupling aperture of the one textile tube, and the facing wall section, bordering the end lip of the adjacent wall section, provide a good seal between the two clipped-together textile tubes.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
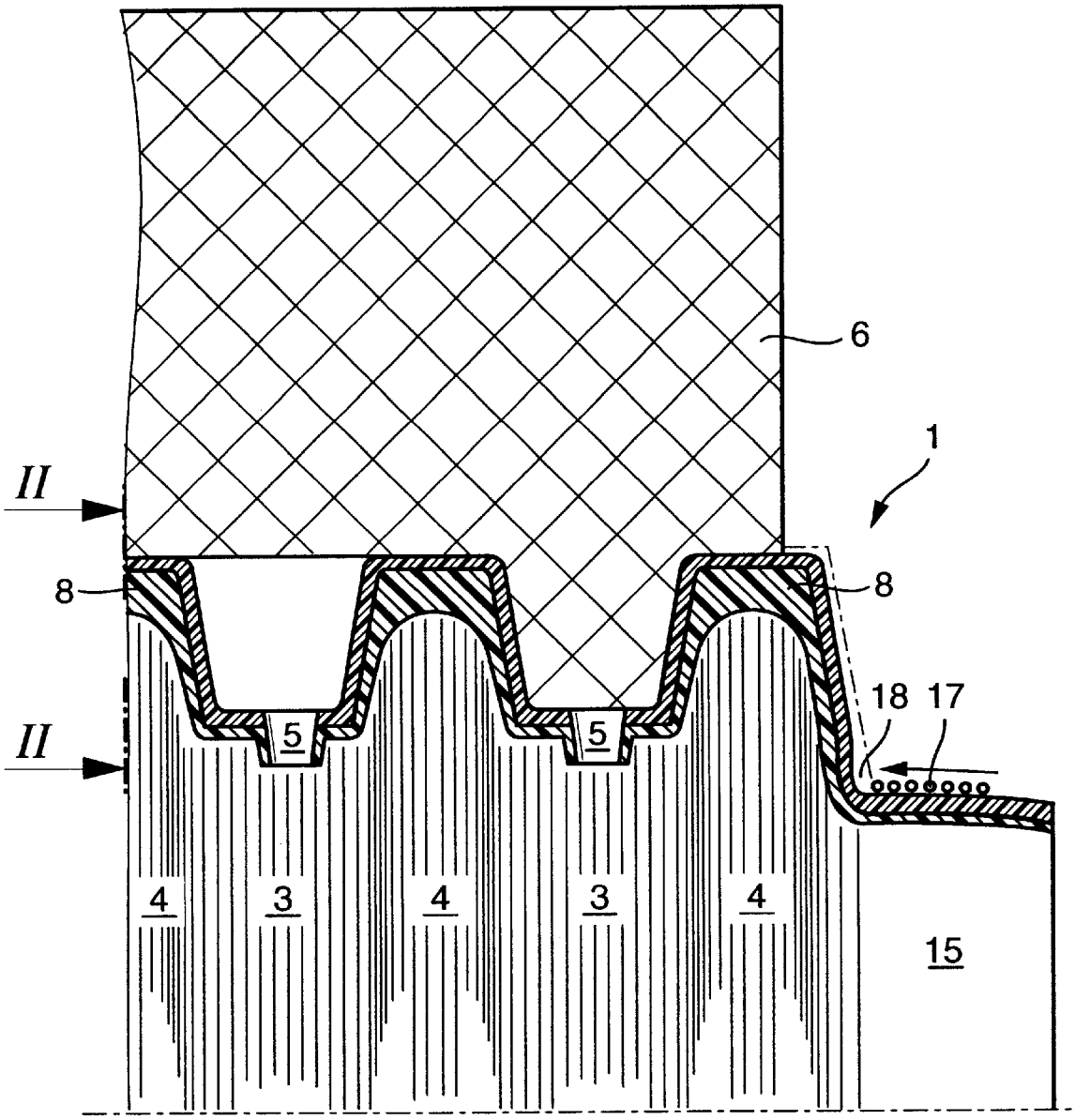
FIG. 1 is a partial longitudinal section through the center plane, marked I—I in FIG. 2, of a textile tube comprising an approximately trapezoidal cross-sectional wave profile, which on the inside is reinforced by several reinforcement ribs arranged offset in respect of each other in a circumferential direction, said reinforcement ribs extending in a longitudinal direction.

A textile tube, designated overall with 1, which textile tube has been produced in an injection-blow molding or injection evacuation process, comprises a wall 2, which in sections is a wave profile with ring-shaped inward bulges 3 and outward bulges 4 alternately arranged side by side in the axial direction. In the area of the inward bulges 3 the wall of the textile tube 1 comprises a multiple number of perforations 5 in its wall 2, arranged in a circumferential direction. During dyeing, the perforations 5 allow even penetration of the dyeing liquor into the goods 6 wound on the textile tube 1. In the axial direction the textile tube 1 is highly deformable even in its cold state, so that prior to heat treatment and/or wet processing of the goods 6 wound onto it, it can be compressed in the axial direction to a significant degree. In this way, the space available in a dyeing apparatus can, for example, be utilized more effectively, i.e., a correspondingly larger number of winding bodies can be placed in the dyeing apparatus.

Figure 2:
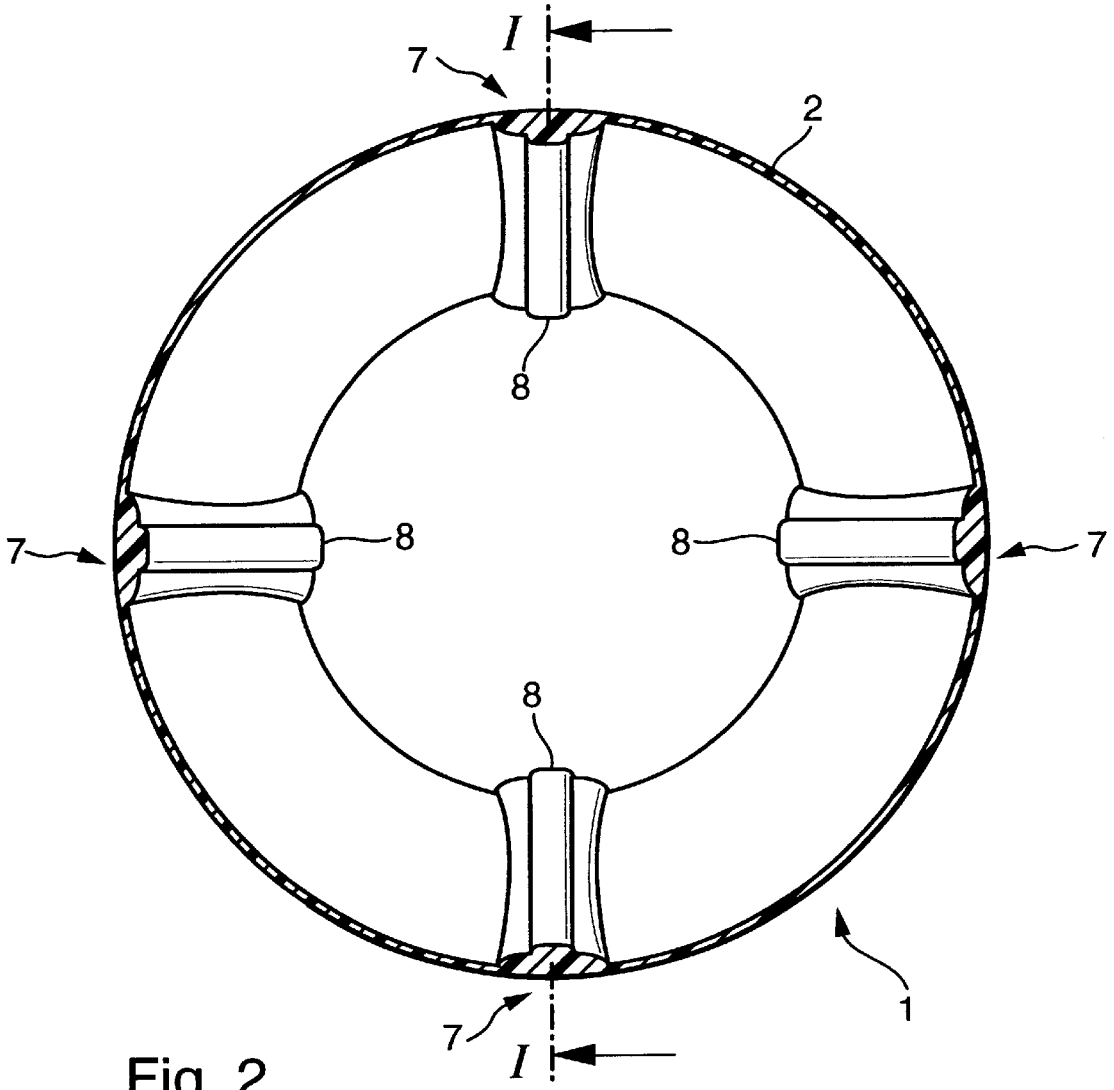
FIG. 2 is a top view onto the cross-sectional plane designated II in FIG. 1.

The textile tube 1 shown in FIG. 1 comprises several strip-shaped areas 7, arranged at its circumference, which strip-shaped areas extend continuously, in axial direction, across all inward bulges 3 and outward bulges 4, which are formed by reinforcement ribs 8 shaped on the inside of the wall 2 of the textile tube 1. The reinforcement ribs 8 are made in one piece together with the wall 2 of the textile tube 1, so that overall a single-layer textile tube 1 results. To illustrate the resulting material cross-section, in addition to that from the actual reinforcement ribs 8, FIG. 1 shows the wall cross-section of the textile tube 1 in various hatch patterns. In reality, the textile tube 1 is, however, largely homogenous. FIG. 2 clearly shows that in a circumferential direction the individual reinforcement ribs 8 extend only across a partial area of the circumference of the textile tube 1, and that between adjacent reinforcement ribs 8 the original wall area is arranged, which is less thick compared to the reinforcement ribs 8. This results in a light, thin-walled but nonetheless stable textile tube of good concentric-running stability. In particular, during winding of the textile goods 6 to be wound onto it in spindle-less winding systems, wobbling of the textile tube 1 and jumping out of its holder is avoided.

FIG. 2 further illustrates that the circular, ring shape of the casing, which is important for even winding of the textile tube 1, is practically unchanged by the reinforcement ribs 8 which are located on the inside of the textile tube 1. On its outside, the textile tube 1 has an even and gradual shape which allows even winding of the textile tube, as well as even support at the textile tube 1 of the compressive forces to which the textile goods 6 to be wound onto it are exposed. Between strip-shaped outer areas 7, adjacent in circumferential direction, the textile tube comprises an essentially constant wall thickness along the axial direction of the outer casing. FIG. 2 also shows that the sharp edges resulting from the injection molding nozzle 9 shown in FIG. 3 are not maintained during the expansion process when shaping the textile tube 1, but are instead flattened off smoothly.

Figure 3:
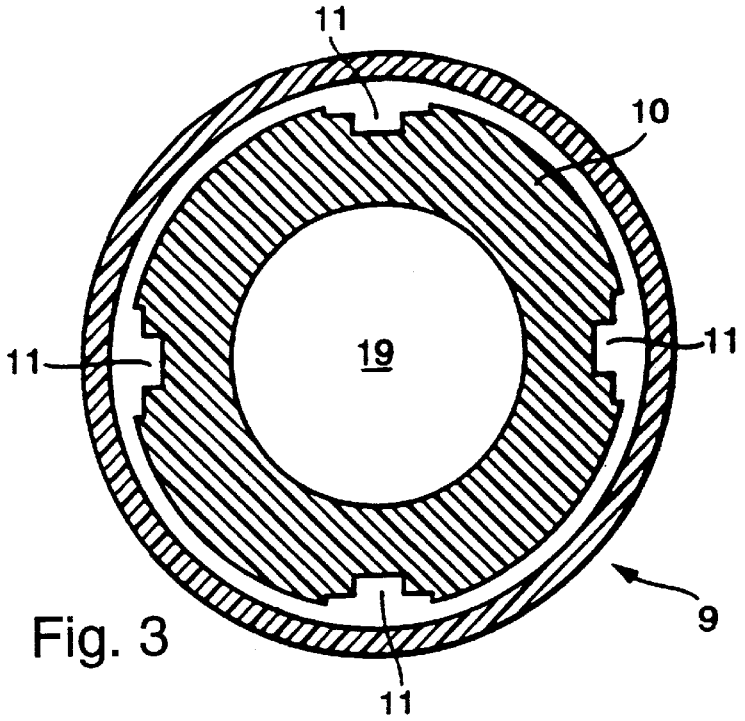
FIG. 3 is a top view of an injection molding nozzle for an injection-blow molding machine or for an evacuation molding machine for producing the textile tube shown in FIGS. 1 and 2.
Figure 4A:
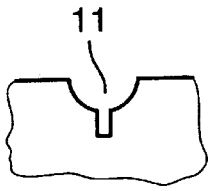
FIGS. 4*a* through 4*j* are fragmented representations of portions of the interior rings of various injection molding nozzles similar to FIG. 3 of an injection-blow molding device, with only the areas of the interior ring comprising an indentation shape for shaping a reinforcement rib being shown.
Figure 4B:
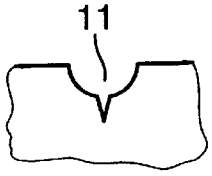
Figure 4C:
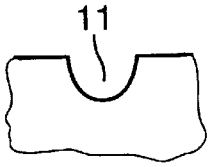
Figure 4D:
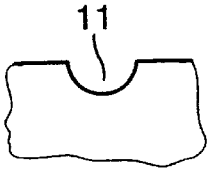
Figure 4E:
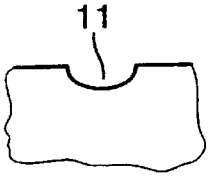
Figure 4F:
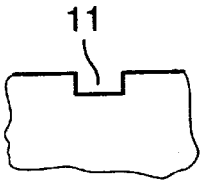
Figure 4G:
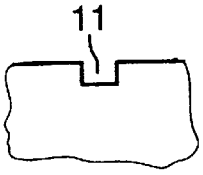
Figure 4H:
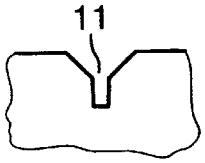
Figure 4I:
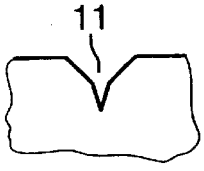
Figure 4J:
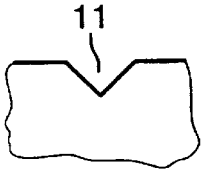

Production of the textile tube 1 takes place in an injection-blow molding or injection evacuation process by means of an injection molding nozzle 9 for example that shown in FIG. 3. Thermoplastic material is extruded therein through the injection molding nozzle 9 to form a hose, which on the inside comprises several reinforcement ribs, offset in relation to each other in circumferential direction, extending in axial direction along the entire length of the hose. During extrusion of the thermoplastic material these reinforcement ribs are formed by one of the indentation shapes 11 located at the outer circumference of the interior ring 10 of the injection molding nozzle 9, with the cross-section of the indentation shapes being generated by the expansion process during injection-blow molding or injection evacuation process, and are substantially flattened off in the inward bulging zones 3 leading to the generation of radially developed ribs in the outward bulging zones 4. Depending on the desired elasticity of the textile tube 1, interior rings 10 with various indentation shapes 11 can be used, for example of T-shaped cross-section (FIG. 3), or of partially rectangular, triangular, circular and/or oval cross-section (FIG. 4). For reasons of clarity, only a partial area of the interior ring 10 of the injection molding nozzle 9 is shown in FIG. 4. For the sake of simplicity, the circular marginal areas of the interior ring 10, which areas are adjacent to the indentation shape 11, are drawn in straight lines. In the case of blow-shaping, an aperture 19 enclosed by the interior ring 10 is used to admit compressed air, while in the case of an evacuation process it is used to admit ambient air.

Figure 6:
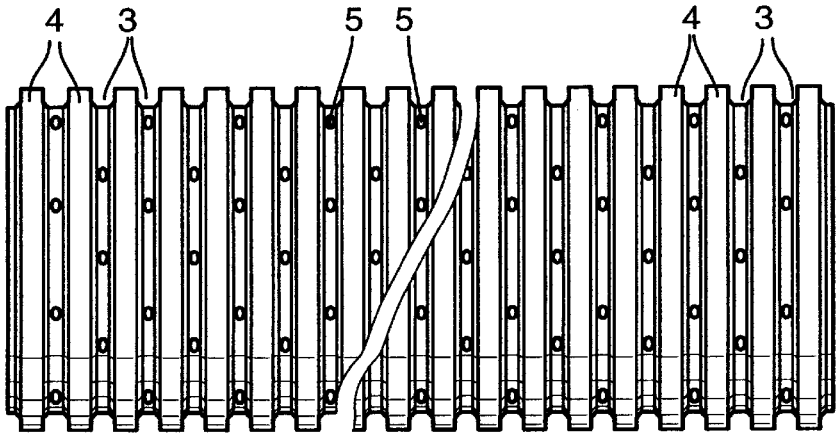
FIG. 6 is a lateral view of the textile tube shown in FIG. 5, as yet without reinforcements.

After extruding the hose, the hose which is still warm is expanded in a tool. During this process the outer wall of the hose presses against the interior wall of the form tool (die) which may, for example, be of trapezoidal cross-section (FIG. 1 or FIG. 6). During this process the inward bulges 3 and outward bulges 4 are formed. At the same time, the sections of the reinforcement ribs 8 located in the area of the outward bulges 4 are deformed in a radial direction, so that their radial dimensions are larger in the area of the outward bulges than in the area of the inward bulges 3.

Correspondingly, the dimensions of the reinforcement ribs 8 in the area of the outward bulges 4 are smaller in sections (FIG. 2) than in the area of the inward bulges 3. This results in a textile tube 1 which on the inside comprises solid cross-sectional reinforcement ribs 8, while nevertheless being easily deformable in axial direction with cold pressing.

Figure 5:
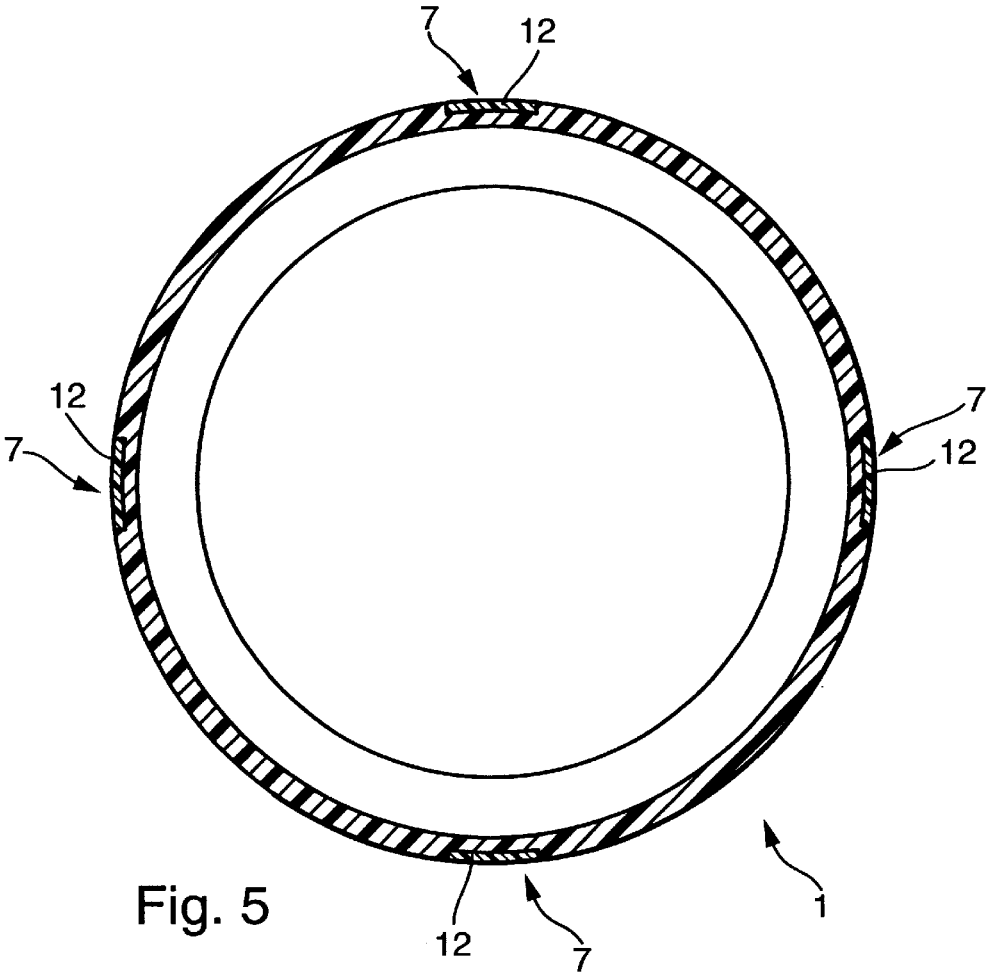
FIG. 5 is a cross-section of a textile tube in whose exterior walls several circumferentially offset strips, each extending in axial direction, have been impressed.
Figure 7:
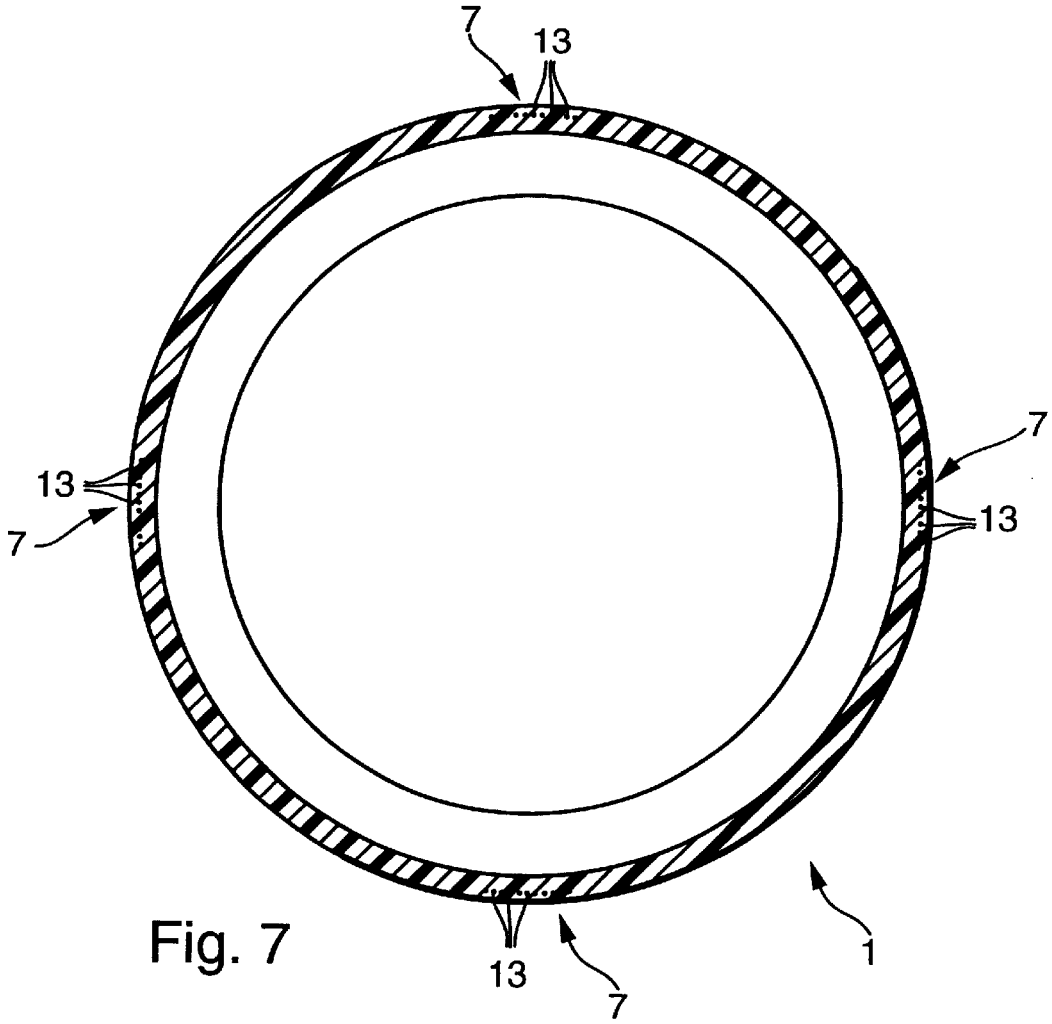
FIG. 7 is a cross-section of a textile tube at the outside of whose walls several thread sheets are integrated, so as to be arranged offset in respect of each other.

In the embodiments according to FIGS. 5 to 7, the strip-shaped areas 7 are recessed into the outside wall 2 of the textile tube 1, with the material of the strip-shaped areas 7 being of different rigidity than the adjacent textile tube material. With the embodiments according to FIGS. 5 and 6, the strip-shaped areas 7 are formed by small strips 12 of plastic, integrated into the wall 2. During production of the textile tube 1, when extruding the hose, the small strips 12 are supplied to the hose on the outside and in the blowing or evacuation mold are pushed into the wall of the textile tube 1. This results in a circumferentially stable shape of the casing of the textile tube 1, said casing being circular in cross-section,. As can be seen in FIG. 6, the textile tube 1 comprises a wave profile of, for example, trapezoidal cross-section, with ring-shaped inward bulges 3 and outward bulges 4 alternately arranged side by side in the axial direction of the textile tube 1. FIG. 6 also shows that the perforations 5 may be of oval cross-section, with the largest dimension being in the circumferential direction of the textile tube 1.

In the embodiment according to FIG. 7, the strip-shaped areas 7 are formed by thread sheets aligned in an axial direction of the textile tube 1. The synthetic threads 13 of said thread sheets may be interconnected by ultrasound welding. During production of the textile tube 1, the loose or already interconnected threads 13 are fed on the outside to the extruded hose at the same speed as that of the extruded material, and in the blowing or evacuation mold are pushed into the wall 2 of the textile tube 1. The threads 13 comprise already hardened replastifiable synthetic spun thread. Consequently, they can adapt well to the outside contour defined by the inward bulges 3 and outward bulges 4 of the textile tube 1. As is the case with the embodiment according to FIGS. 5 and 6, with this embodiment too a textile tube 1 results with a circular, ring-shaped exterior casing, smooth in circumferential direction.

Compared to the thermoplastic material of the wall 2 of the textile tube 1, the synthetic material of the threads 13 comprises a higher molecular weight. As a result, the wall 2 is reinforced in the area of the thread sheets despite a constant wall thickness in circumferential direction.

Figure 10:
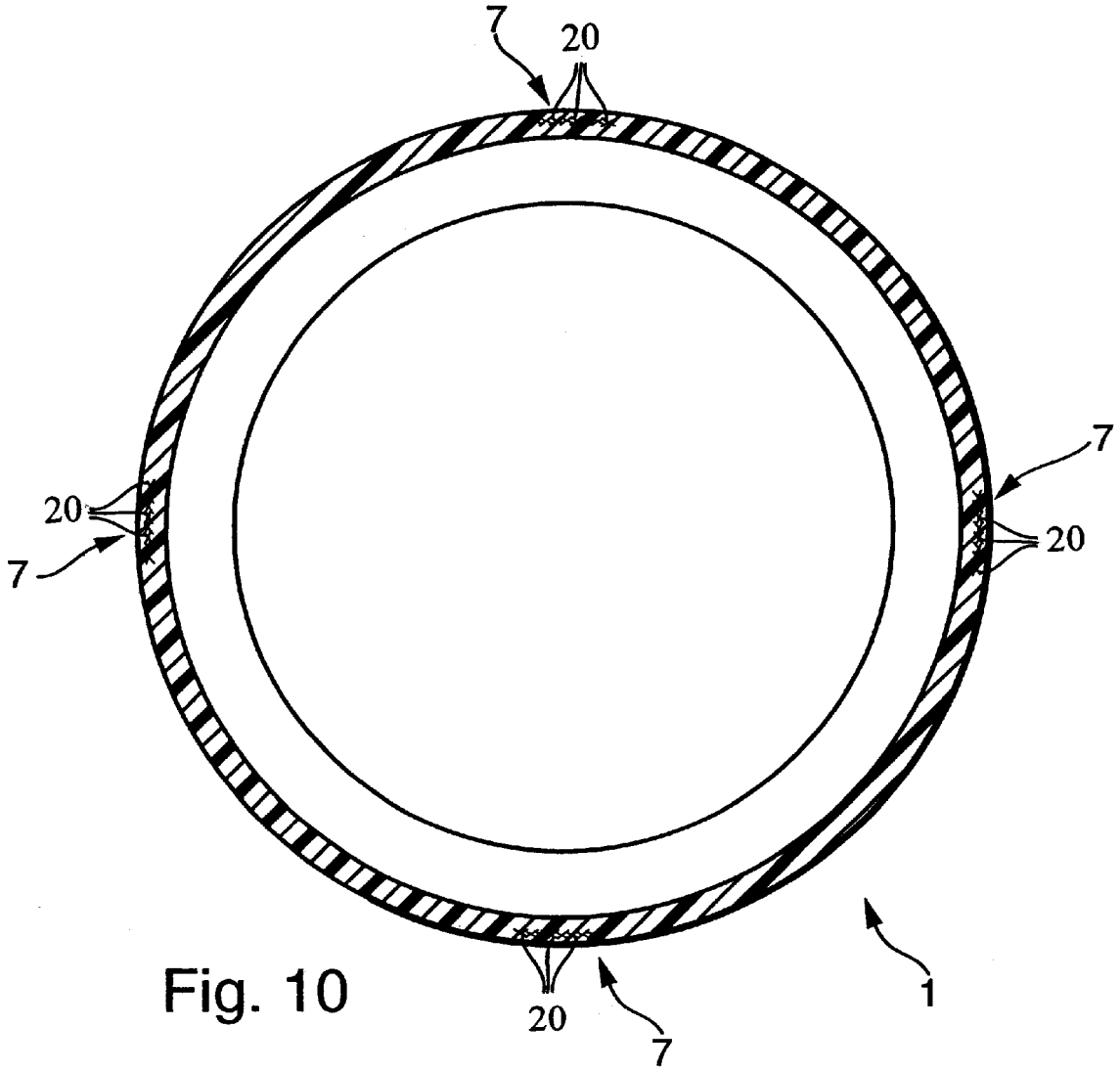
FIG. 10 is a cross-section of a textile tube in whose exterior walls several textile fabrics have been integrated, so as to be arranged offset in respect of each other.

In the embodiment according to FIG. 10, the strip-shaped areas 7 are formed by textile fabric strips 20, aligned in an axial direction of the textile tube 1.

Figure 8:
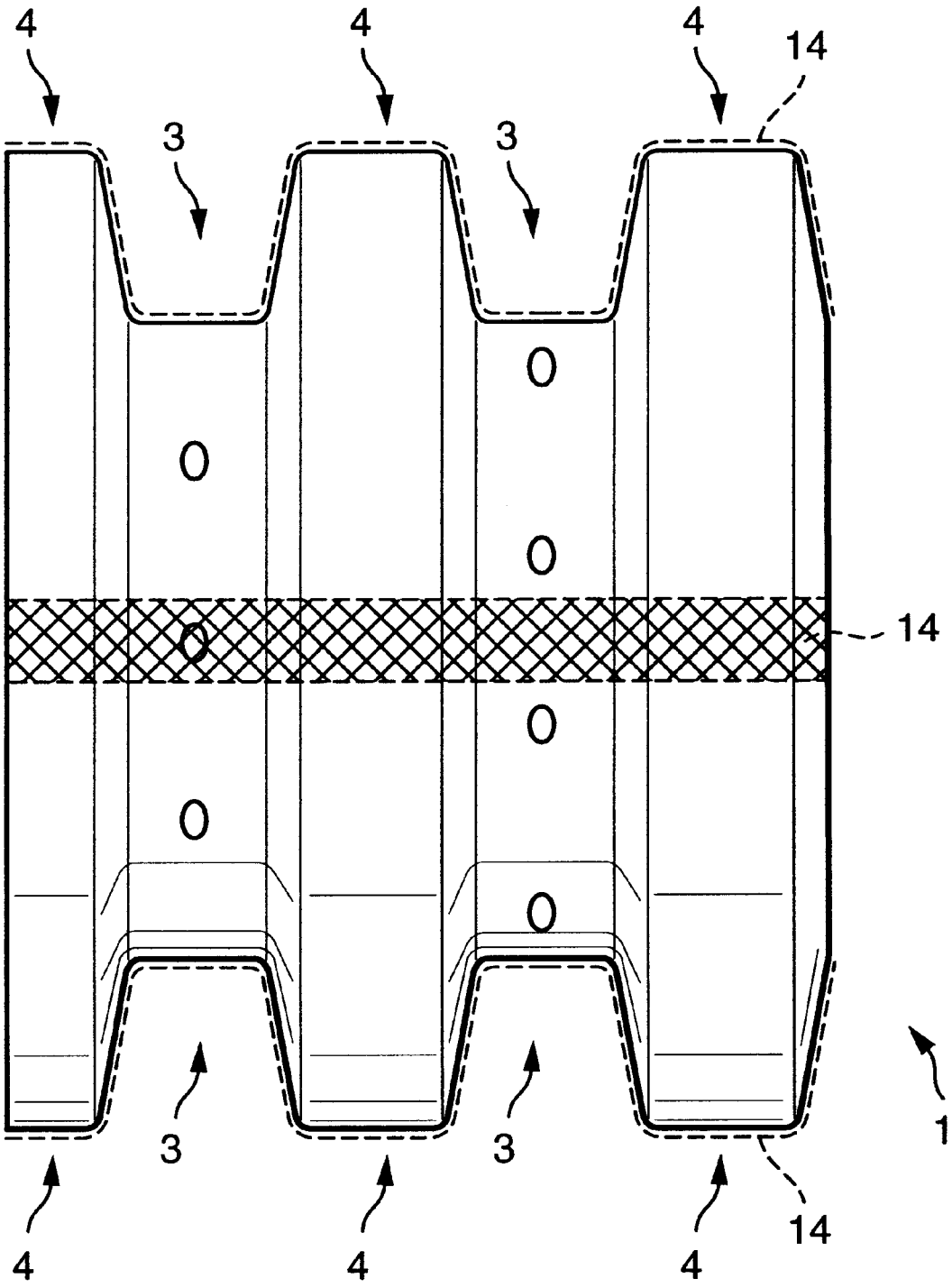
FIG. 8 is a lateral view of a textile tube to whose outside wall after shaping the textile tube, several flat tension elements have been welded, with said tension elements being circumferentially arranged and extending in axial direction.

With the embodiment according to FIG. 8, the strip-shaped areas 7 are formed by flat tension elements 14 of any of the type described above, which in the axial direction following the outside contour 2 of the textile tube 1 are connected by means of laser welding and/or ultrasound welding in any area of the inward bulges 3 or outward bulges 4 to the wall 2 of the already completely formed textile tube 1. Thus, fixing the tension elements 14 to the textile tube 1 by means of laser welding and/or ultrasound welding only takes place after the shaping process, so that the existing production equipment already used in the production of conventional textile tubes can continue to be used. As a result of the flat tension elements 14 arranged at the outside of the textile tube 1, the textile tube 1 is likewise reinforced in particular areas, with the outer shape of the casing of said textile tube 1 essentially being maintained. The same production process also applies to the production of the earlier-mentioned fabrics with metallic or metallized filament or staple fiber fractions.

Figure 9:
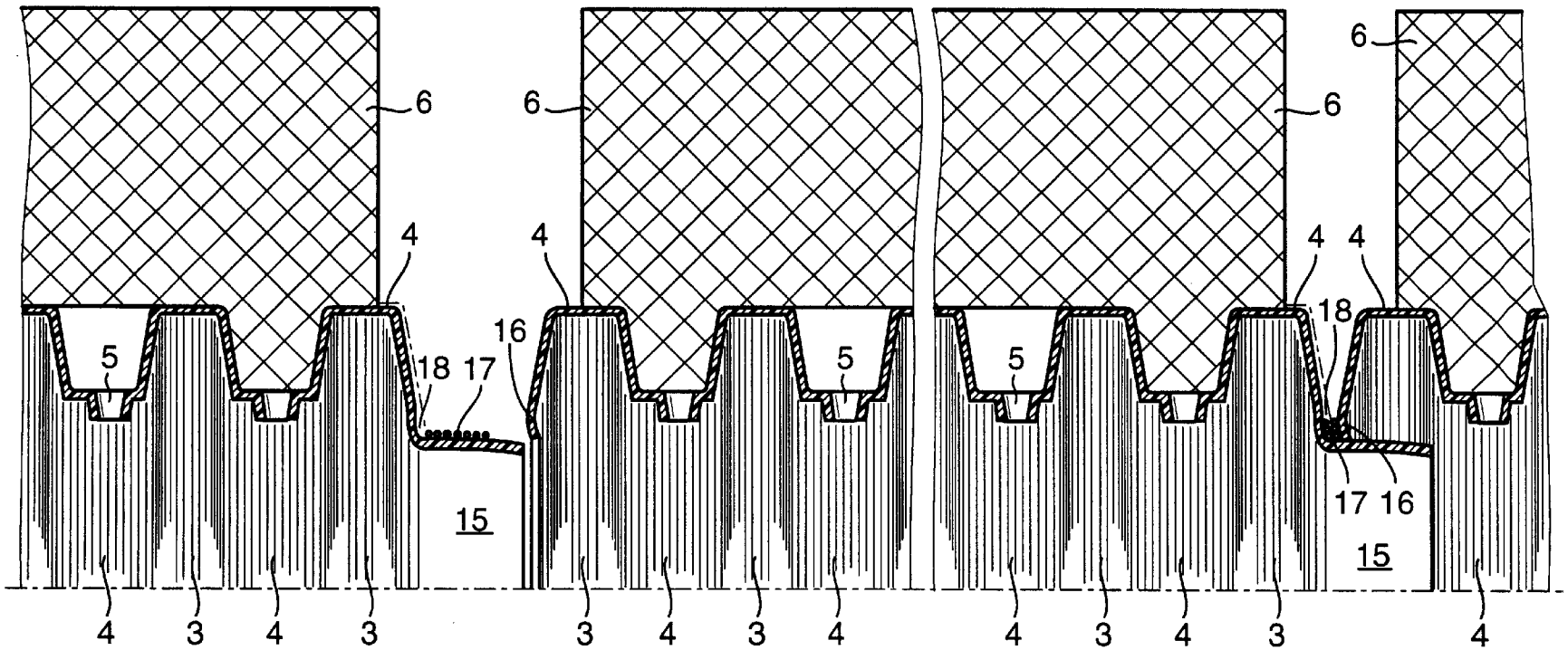
FIG. 9 is a partial cross-section of several textile tubes, stackable or stacked one on top of the other, each textile tube respectively comprising at one end a clip-on lip and at the other end a matching coupling aperture.

As is shown particularly clearly in FIG. 9, the textile tube 1 can also be a clip-on tube which at one axial end comprises a conical end lip 15 tapering off towards the axial end and at its other axial end comprises a matching coupling aperture. It is thereby possible to clip several textile tubes 1 onto each other, so that they are then arranged one after another in the axial direction. Herein, the end lip 15 of one of two adjacent textile tubes 1 positively engages the coupling aperture of the other textile tube 1. In the area of that end of the end lip 15 facing away from the axial end of the textile tube 1, there may be a free space for a thread reserve 17 (FIG. 1). To allow gentle and destruction-proof compacting of the thread reserve 17 in the area 18, the wall area 16 surrounding the coupling aperture of the textile tube 1 and the wall section 18 adjacent to the end lip 15, extending in the circumferential direction of the textile tube 1, are of flexible construction. This can be achieved in that the wall thickness of the wall area 16 and of the wall section 18 is less than the wall thickness of the end lip 15.

The wall section 18 adjacent to the end lip 15 comprises an indentation shape 15 which, in longitudinal section according to FIG. 9, is half saucer-shaped, pointing away from the end lip 15, surrounding the textile tube 1 in the circumferential direction. At the axial end of the textile tube 1, the wall area 16 enclosing the coupling aperture comprises an outward shape matched to the indentation shape, extending in the circumferential direction. FIG. 9, left clearly shows that the threads of the thread reserve prior to clipping the textile tubes 1 together at the exterior circumference of the end lip 15, are first grouped flat and wide. In the case of textile tubes 1 clipped together in the coupled position (FIG. 9, right), the thread reserve 17 is compacted between the indentation shape of the one textile tube 1 and the adjacent outward shape of the other textile tube 1.

In summary, the invention relates to a textile tube 1 made in an injection-blow molding process and/or an injection evacuation process, with the wall 2 of said textile tube 1 comprising a wave profile with ring-shaped inward bulges 3 and outward bulges 4 alternately arranged side by side in an axial direction. The textile tube 1 has perforations 5. In several places arranged offset in respect of each other, in the circumferential direction, the textile tube 1 comprises strip-shaped areas 7 extending continuously in the axial direction across adjacent inward bulges 3 and outward bulges 4. The strip-shaped areas 7 have a rigidity that differs from the rigidity of radially adjacent areas of the textile tube; with the strip-shaped areas essentially following the shape of the casing of the textile tube.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A textile tube made in an injection-blow molding process and/or an injection evacuation process, the textile tube (1) comprising a wall (2), at least a portion of the wall (2) having a wave profile with ring-shaped inward bulges (3) and outward bulges (4) alternately arranged side by side in an axial direction, perforations (5) in the wall (2), and a plurality of strip-shaped areas (7) arranged at a circumference of the tube (1), the strip-shaped areas (7) extending continuously in an axial direction across adjacent inward bulges (3) and outward bulges (4) and having a rigidity that differs from a rigidity of radially adjacent wall areas of the tube (1), wherein the strip-shaped areas (7) substantially follow the wave profile of the wall (2) to at least substantially maintain an exterior shape of the wall (2).

2. The textile tube according to claim 1, wherein the strip-shaped areas (7) comprise reinforcements.

3. The textile tube according to claim 2, wherein the strip-shaped areas (7) comprise reinforcement ribs (8) formed in one piece together with the wall (2) of the textile tube (1), the reinforcement ribs (8) being substantially developed radially in the outward bulges (4), and in an area of the inward bulges (3) the ribs (8) have smaller radial dimensions than in an area of the outward bulges (4).

4. The textile tube according to claim 1, wherein the strip-shaped areas (7) are recessed into the wall (2) of the textile tube (1), and a material of the strip-shaped areas (7) is of different rigidity than that of adjacent textile tube material.

5. The textile tube according to claim 1, wherein a material of the strip-shaped areas (7) has a higher molecular weight than that of adjacent textile tube material located between adjacent strip-shaped areas (7).

6. The textile tube according to claim 5, wherein the strip-shaped areas (7) comprise strips (12) extending in an axial direction.

7. The textile tube according to claim 1, wherein the strip-shaped areas (7) comprise a thread sheet with threads (13) grouped flat and wide.

8. The textile tube according to claim 7, wherein the threads (13) of the thread sheet are interconnected by welding.

9. The textile tube according to claim 1, wherein the strip-shaped areas (7) comprise textile fabrics.

10. The textile tube according to claim 9, wherein the textile fabrics are selected from the group consisting of metallic filaments, staple fiber fractions, monofilament synthetic threads, multifilament synthetic threads, and synthetic threads spirally covered by metallic threads.

11. The textile tube according to claim 1, wherein the strip-shaped areas (7) are flat tension elements (14), wherein the elements (14) are welded at least in certain areas on an outside of the wall (2) of the textile tube (1).

12. The textile tube according to claim 1, wherein the textile tube (1) is clipable to a further textile tube (1), adjacent textile tubes (1) having respectively at one of their axial ends facing away from each other a coupling aperture and at their other axial end an end lip (15) clipable into the coupling aperture of the other textile tube, wherein an exterior circumference of the end lip (15) comprises a receptacle for a thread reserve (17), and wherein at least one of a wall area (16) enclosing the coupling aperture and a radial wall section (18) adjoining the end lip (15) is flexible and has a lesser wall thickness than the end lip (15).

13. The textile tube according to claim 1, wherein the tube (1) has a circumferential shape which is circular and constant.

* * * * *